United States Patent [19]

Daar et al.

[11] Patent Number: 4,521,223

[45] Date of Patent: Jun. 4, 1985

[54] METHOD FOR DETERMINING THE EXISTENCE OF AN OPTIMAL INTERVAL FOR RAPPING THE ELECTRODES OF AN ELECTROSTATIC PRECIPITATOR

[75] Inventors: Horst Daar, Erlangen; Franz Alig, Johannesberg, both of Fed. Rep. of Germany

[73] Assignees: Siemens Aktiengesellschaft, Munich; Metallgesellschaft Aktiengesellschaft, Frankfurt am Main, both of Fed. Rep. of Germany

[21] Appl. No.: 628,776

[22] Filed: Jul. 9, 1984

[30] Foreign Application Priority Data

Jul. 20, 1983 [DE] Fed. Rep. of Germany ..... 3326040

[51] Int. Cl.[3] ..... B03C 3/76

[52] U.S. Cl. ..... 55/13; 55/105; 55/112

[58] Field of Search ..... 55/4, 13, 105, 112; 323/903

[56] References Cited

U.S. PATENT DOCUMENTS

| | | | |
|---|---|---|---|
| 3,147,094 | 9/1964 | Hall et al. | 55/105 |
| 3,469,371 | 9/1969 | Gelfand . | |
| 3,606,733 | 9/1971 | Arstikaitis . | |
| 4,432,062 | 2/1984 | Herklotz et al. | 55/112 X |

FOREIGN PATENT DOCUMENTS 1091398 11/1967 United Kingdom .

*Primary Examiner*—Kathleen J. Prunner

*Attorney, Agent, or Firm*—Kenyon & Kenyon

[57] ABSTRACT

A method for operationally determining the existence of an optimal rapping interval for the collector electrodes of an electrostatic precipitator comprises the comparison of the current-voltage characteristics for precipitator operation under pure-gas conditions and actual use conditions. If the comparison indicates that the resistance of accumulated dust layers is greater than the resistance of air, then an optimal rapping interval exists. This interval may be calculated analytically or approximated by means of an iterative process.

5 Claims, 3 Drawing Figures

METHOD FOR DETERMINING THE EXISTENCE OF AN OPTIMAL INTERVAL FOR RAPPING THE ELECTRODES OF AN ELECTROSTATIC PRECIPITATOR

BACKGROUND OF THE INVENTION

This invention relates to electrostatic precipitators or filters by means of which dust particles are removed from an air stream. In particular, this invention relates to a method for operationally ascertaining the existence of an optimal interval or period for rapping the electrodes of such a precipitator.

In one kind of conventional electrostatic precipitator, dust or particle charged air flows between collector plates which are electrically coupled to one another. The voltage across the collector plates causes the solid particles suspended in the air flowing between the plates to move towards one or the other of the electrodes and to become deposited thereon. The electrodes are periodically cleaned of the resulting dust layers by means of a mechanical knocking or rapping operation. If, on the one hand, the rapping occurs too infrequently, the size of the dust layers on the collector electrodes may periodically become so large as to cause a distinct reduction in the performance of the precipitator. If, on the other hand, the rapping occurs too frequently, the mean dust content of the air at the output of the precipitator may undergo a substantial and undesirable increase. From these facts it might be assumed that there is a rapping interval at which the mean dust content of the outflowing air is a minimum. However, investigations and calculations show that this is not always the case, i.e., that there are types of dust for which actual optimal rapping periods do not exist. For both analytic and iterative methods of computation it is important to known whether there is, for a given type of dust, an optimal rapping period or interval, i.e., a rapping interval resulting in a mimimal mean dust content of the air at the output of the precipitator.

An object of the present invention is to provide a method for operationally determining the existence of an optimal rapping interval for the electrodes of an electrostatic precipitator.

Another object of the present invention is to provide such a method by means of which an optimal rapping interval may be calculated from operationally determined parameters.

SUMMARY OF THE INVENTION

A method for operationally ascertaining the existence of an optimal knocking or rapping period for cleaning the collector electrodes of an electrostatic precipitator comprises the steps of measuring the current flow to and the voltage across at least one pair of collector electrodes during the operation of the precipitator under dust free gas flow conditions and determining from these measurements a current-voltage characteristic for dust-free operation of the precipitator. The current flow to and the voltage across at least one interconnected pair of collector electrodes is also measured during operation of the precipitator under actual use conditions, a current-voltage characteristic for actual use operation of the precipitator being determined from the measurements of current flow and voltage. The current-voltage characteristics for operation of the precipitator under dust-free and under actual use conditions are then compared to determine whether the electrical resistance of a dust layer on the electrodes is at least equal to the electrical resistence of pure gas, e.g., dust-free air, during dust-free operation of the precipitator. If the resistence of the dust layer is equal to or greater than the electrical resistance of pure air, an optimal knocking or rapping period exists.

In accordance with another feature of the present invention, the optimal rapping period $T_{opt}$ is calculated by means of the equation:

$$T_{opt}=T(R_{sto}/R_{st})^{\frac{1}{2}}.$$

To determine the parameters T, $R_{sto}$ and $R_{st}$, the precipitator is operated under actual-use flow conditions and at a substantially constant bulk flow rate. During the operation of the precipitator the electrodes are periodically rapped at a uniform interval T. The electrical resistance $R_{st}$ across at least one pair of interconnected collector electrodes is measured immediately prior to a rapping of the pair of interconnected electrodes. The electrical resistance $R_{sto}$ across the pair of interconnected collector electrodes is also measured in the absence of dust layers on the electrodes and at the bulk flow rate. The uniform rapping interval T advantageously constitues a previously determined optimal rapping or knocking period.

With regard to computing the optimal rapping interval, it should be assumed, for different bulk currents, that the square of the ratio of the respective optimal rapping interval is equal to the ratio of the bulk currents.

In accordance with another feature of the present invention, the optimal rapping interval may be computed by means of an iterative process rather than an analytical calculation. If the resistance of the dust layer is determined to be smaller than the resistance of dust-free gas, i.e., normally smaller than the resistivity of air, it must be assumed that an optimal rapping interval does not exist. In such a case, the rapping interval is advantageously set in accordance with experience.

DETAILED DESCRIPTION

Figure 1:
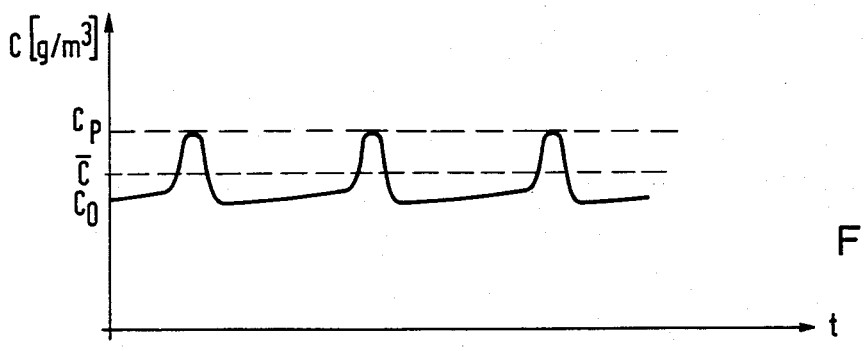
FIG. 1 is a graph, as a function of time, of the dust content of air at the output of a precipitator, the collector electrodes of which are periodically rapped.

As illustrated in the graph of FIG. 1, the dust content of the air at the output of an electrostatic precipitator having electrically energizable collector electrodes has a minimum value $c_o$ which is attained when there is no dust accumulated on the collector electrode plates. Minimum dust content $c_o$ occurs at the onset of precipitator operation and substantially reoccurs each time upon the cleaning of the electrodes by a rapping or knocking thereof. Between raps of the electrodes the dust content of the outflowing air increases gradually owing to the build up of dust on the surfaces of the collector electrodes and to a resulting decrease in voltage there across. Upon the rapping of the electrodes, the dust content of the out-flowing air increases sharply to a peak value $c_p$ and then decreases to minimum value $c_o$. It is to be noted that the gradual increase in dust content of the out-flowing air illustrated in FIG. 1 applies to a situation in which the resistivity of the dust particles is greater than the resistivity of air.

To determine whether an optimal rapping interval $T_{opt}$ exists, i.e., an inter-rap period which minimizes the mean dust content of the air leaving the precipitator at the output thereof, the current-voltage characteristic of the precipitator operated with dust-free air is first determined. This current-voltage characteristic is represented by the dashed line A in FIG. 2. The current-voltage characteristic of the precipitator under actual use conditions is also determined. If the actual use curve (B in FIG. 2) indicates that the resistance of dust layers accumulated on the collector electrodes of the precipitator is greater than the resistance of the air, then an optimal rapping interval exists. The voltage difference U between the characteristic curves A and B for the same filter current $J_f$ is a measure of the dust resistance $R_{st}$ since $R_{st}=U/J_f$. Because for highly conductive dust, i.e., dust which conducts substantially better than air, no voltage drop occurs at the dust layers on the collector electrodes, it must be assumed that a value of voltage difference U which exceeds a threshold value can serve as an index for poorly conducting dust, i.e., dust having a resistivity higher than that of air.

Figure 2:
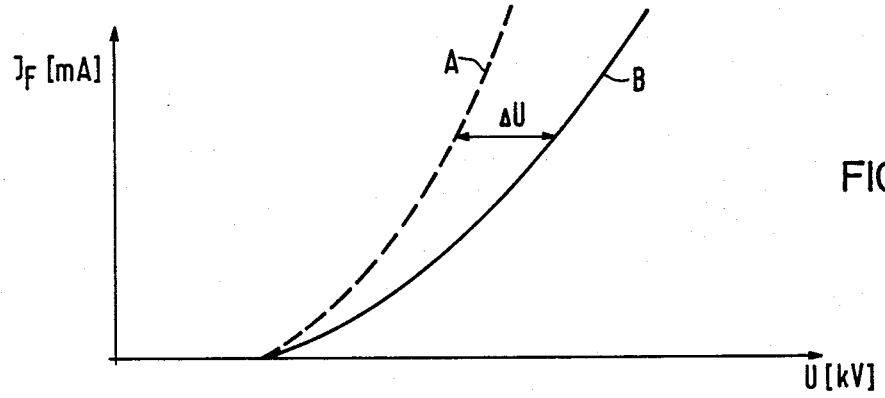
FIG. 2 is a graph of electrode current as a function of voltage across the electrodes during precipitator operation under pure gas and actual use conditions.

If a comparison of the current-voltage characteristics A and B illustrated in FIG. 2 indicates that the resistivity of the deposited dust layers is greater than the resistivity of air, i.e., that there is a rapping interval $T_{opt}$ at which the dust content of the out-flowing air is minimized, the rapping interval $T_{opt}$ is calculated from the following equation:

$$T_{opt}=T(R_{sto}/R_{st})^{\frac{1}{2}},$$

where the parameter T is a rapping interval determined by previous calculations or experimental tests and parameter $R_{st}$ represents the dust resistance measured at this rapping interval prior to rapping.

Figure 3:
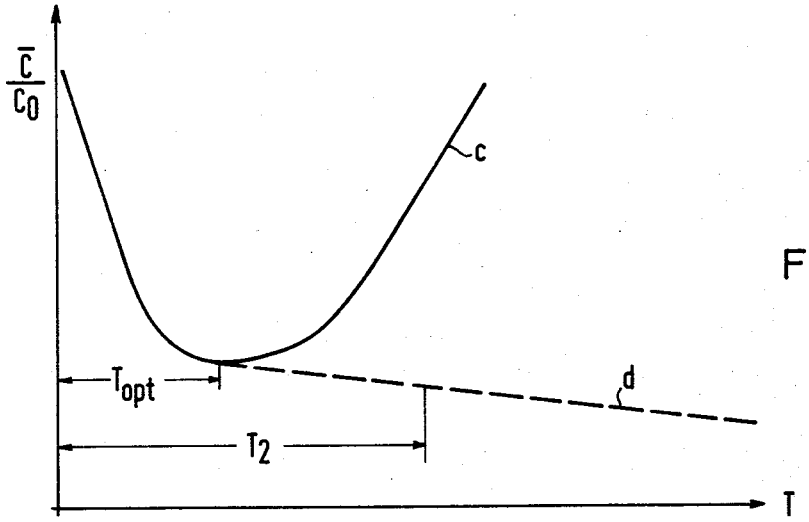
FIG. 3 is a graph showing, as a function of the rapping interval, the ratio of the mean dust content of the air at the output of a precipitator to the mimimum dust content in the output air.

If the comparison of the current-voltage characteristics A and B in FIG. 2 indicates that the dust accumulated on the collector electrodes is highly conductive, a rapping interval $T_2$ is selected on the basis of experience from curve d in FIG. 3, which curve represents the mean dust content of out-flowing air as a function of the rapping interval for highly conductive dust.

What is claimed is:

1. A method for operationally determining the existence of an optimal knocking period for the rapping of the collector electrodes for an electrostatic precipitator, comprising the steps of:

(a) operating the precipitator under dust-free gas flow conditions;

(b) during the execution of step (a), measuring the current flow to and the voltage across at least one pair of the electrodes;

(c) determining, from the measurements of current flow and voltage in step (b), a current-voltage characteristic for dust-free operation of said precipitator;

(d) operating said precipitator under actual use conditions;

(e) during the execution of step (d), measuring the current flow to and the voltage across at least said one pair of said electrodes;

(f) determining, from the measurements of current and voltage in step (e), a current-voltage characteristic for actual use operation of said precipitator; and (g) comparing the current-voltage characteristic arrived at in step (f) with the current-voltage characteristic arrived at in step (c) to determine whether the electrical resistance of a dust layer accumulated on said electrodes during actual use operation is at least equal to the electrical resistance of pure gas passing between said electrodes during dust-free operation of said precipitator, thereby determining whether an optimal knocking period exists.

2. The method defined in claim 1 further comprising the steps of:

(h) operating said precipitator under actual use flow conditions and at a substantially constant bulk flow rate;

(i) during the execution of step (h), periodically rapping said electrodes at a uniform interval T;

(j) measuring the electrical resistance $R_{st}$ across at least one pair of interconnected collector electrodes substantially immediately prior to a rapping of said pair of interconnected collector electrodes;

(k) measuring the electrical resistance $R_{sto}$ across said pair of interconnected collector electrodes in the absence of dust layers thereon and at said bulk flow rate; and (l) calculating the optimal knocking period $T_{opt}$ by means of the equation:

$$T_{opt}=T(R_{sto}/R_{st})^{\frac{1}{2}}.$$

3. The method defined in claim 2 wherein said uniform interval T constitutes a previously determined optimal knocking period.

4. The method defined in claim 1, further comprising the step of iteratively searching for the optimal knocking period.

5. The method defined in claim 1 further comprising the steps of:

(h) operating said precipitator under actual use flow conditions and at a substantially constant first bulk flow rate $B_{st}$;

(i) during the execution of step (h), periodically rapping said electrodes at a uniform interval T;

(j) measuring the electrical resistance $R_{st}$ across at least one pair of interconnected collector electrodes substantially immediately prior to a rapping of said pair of interconnected collector electrodes;

(k) measuring the electrical resistance $R_{sto}$ across said pair of interconnected collector electrodes in the absence of dust layers thereon and at a substantially constant second bulk flow rate $B_{sto}$; and (l) calculating the optimal knocking period $T_{opt}$ by means of the equation:

$$T_{opt}=T(R_{sto}/R_{st})^{\frac{1}{2}}(B_{sto}/B_{st})^{\frac{1}{2}}.$$

* * * * *